US007742714B2

(12) United States Patent
Shinshi et al.

(10) Patent No.: US 7,742,714 B2
(45) Date of Patent: Jun. 22, 2010

(54) IMAGE FIXING APPARATUS, IMAGE FORMING APPARATUS, AND IMAGE FIXING METHOD CAPABLE OF EFFECTIVELY CONTROLLING AN IMAGE FIXING TEMPERATURE

(75) Inventors: Akira Shinshi, Machida (JP); Hiroshi Seo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 836 days.

(21) Appl. No.: 11/519,007

(22) Filed: Sep. 12, 2006

(65) Prior Publication Data

US 2007/0059003 A1 Mar. 15, 2007

(30) Foreign Application Priority Data

Sep. 12, 2005 (JP) ..... 2005-263515

(51) Int. Cl.
*G03G 15/20* (2006.01)

(52) U.S. Cl. ..... 399/68; 399/45; 399/322; 399/400

(58) Field of Classification Search ..... 399/45, 399/68, 69, 322, 400
See application file for complete search history.

(56) References Cited

U.S. PATENT DOCUMENTS 6,304,731 B1 * 10/2001 Able et al. ..... 399/45
6,882,820 B2 4/2005 Shinshi et al.
2002/0141772 A1 * 10/2002 Kawano ..... 399/68
2005/0129432 A1 6/2005 Sato et al.
2005/0163543 A1 7/2005 Satoh et al.
2006/0002737 A1 1/2006 Shinshi
2006/0116230 A1 6/2006 Satoh et al.
2006/0165429 A1 7/2006 Satoh et al.
2006/0269307 A1 * 11/2006 Funabiki et al. ..... 399/45
2008/0138502 A1 6/2008 Trassl et al.

FOREIGN PATENT DOCUMENTS

| | | |
|---|---|---|
| JP | 08-069205 | 3/1996 |
| JP | 08-220930 | 8/1996 |
| JP | 10-142975 | 5/1998 |
| JP | 2002-091226 | 3/2002 |
| JP | 2004-117626 | 4/2004 |
| JP | 2005-202441 | 7/2005 |

* cited by examiner

*Primary Examiner*—David M Gray
*Assistant Examiner*—Ruth N Labombaard
(74) *Attorney, Agent, or Firm*—Oblon, Spivak, McClelland, Maier & Neustadt, L.L.P.

(57) ABSTRACT

An image forming apparatus, an image fixing apparatus, and an image fixing method that fix a toner image onto an recording medium in an electrophotographic process capable of effectively controlling an image fixing temperature. In one example, when a narrower recording medium, narrower than a maximum allowable size, is continuously fed at an image fixing temperature, a gap between the conveyed recording mediums is controlled to be longer than a default gap corresponding to a wider recording medium in a feeding direction to avoid an increase of the temperature of the ends of the fixing member in the longitudinal direction, to thereby maintain an allowable temperature limit.

13 Claims, 5 Drawing Sheets

IMAGE FIXING APPARATUS, IMAGE FORMING APPARATUS, AND IMAGE FIXING METHOD CAPABLE OF EFFECTIVELY CONTROLLING AN IMAGE FIXING TEMPERATURE

BACKGROUND OF THE INVENTION

1. Field of the Invention

The present invention generally relates to an image forming apparatus such as a printer, a copying machine, a facsimile, etc., which forms an image on a recording medium such as paper, an OHP sheet, cloth, etc., and to an image fixing apparatus and an image fixing method in which the image on the recording medium is fixed by heat and pressure in a nip press region between a fixing member and a pressing member. The present invention more particularly relates to an image forming apparatus, an image fixing apparatus, and an image fixing method capable of effectively controlling an image fixing temperature.

2. Discussion of the Background

A background image forming apparatus such as a printer, a copying machine, a facsimile, etc. mostly adopts an electrophotographic process from the considerations of speed, image quality, cost, etc. The electrophotographic process includes operations of charging a photo-conductor, forming an electrostatic image by irradiating, developing to form a toner image, transferring the toner image onto a recording medium, and fixing the toner image on the recording medium.

Accordingly, such a kind of image forming apparatus using an electrophotographic process is equipped with an image fixing apparatus for fixing the toner image. As the fixing apparatus, a hot pressing type apparatus is mostly adopted from the consideration of safety. The hot pressing type fixing apparatus has a fixing nip press region between a fixing member, which is a drum or a belt to be heated, and a pressing member, which is also a drum or a belt for pressing. The toner image on a recording medium is fixed by heat and pressure in the nip press region.

FIG. 1 illustrates a cross sectional view of an exemplary configuration of a background fixing apparatus. A rotating fixing member 1 includes a heater 2 inside. A temperature sensor 3 is provided on the surface of the rotating fixing member 1. A rotating pressing member 4 presses the rotating fixing member 1 to form a fixing nip press region n. When a recording medium P passes through the fixing nip press region n, a toner image may be fixed by heat and pressure on the recording medium P. FIG. 2 illustrates another cross sectional view of the fixing apparatus of FIG. 1. The detected result by the temperature sensor 3 is input into a central processing unit (CPU) 7 through an input circuit 6. The CPU 7 controls the heater 2 through a driver 8 based on the detected result by the temperature sensor 3.

When a recording medium p2, which has a narrower width than a recording medium p1, is continuously fed, non-feeding areas m on both sides in the longitudinal direction may have a high temperature because heat in these areas is not absorbed in the recording medium p2. This may cause a problem. The problem is a decrease of the fixing apparatus life due to the higher temperature of the ends of the rotating fixing member 1 that exceeds an allowable temperature limit.

To avoid the problem, some image forming apparatuses have a fixing apparatus in which a fixing roller has two heaters, one for heating the center part of the fixing roller in the longitudinal direction, and the other for heating the end parts of the fixing roller. When using the narrower recording medium, only the heater for heating the center part of the fixing roller in the longitudinal direction is turned on, so the temperature of the ends of the rotating fixing member may rise but stays below the allowable temperature limit.

To avoid the problem in other examples, some image forming apparatuses have a fixing apparatus in which a temperature of the end parts of the fixing roller is detected, and a feeding timing of the recording medium may be controlled based on the detected temperature. For example, if the end parts of the fixing roller are expected to have a high temperature, the gap between the conveying recording mediums may be longer than a normal gap, and then the temperature of the ends of the rotating fixing member may rise but still be less than the allowable temperature limit.

SUMMARY OF THE INVENTION

The present invention sets forth a novel image forming apparatus, a novel image fixing apparatus, and a novel image fixing method that fix a toner image onto an recording medium in an electrophotographic process capable of effectively controlling an image fixing temperature. In one example, when a narrower recording medium, narrower than a maximum allowable size, is continuously fed at an image fixing temperature, a gap between the conveyed recording mediums is controlled to be longer than a default gap corresponding to a wider recording medium in a feeding direction to avoid an increase of the temperature of the ends of the fixing member in the longitudinal direction for maintaining an allowable temperature limit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
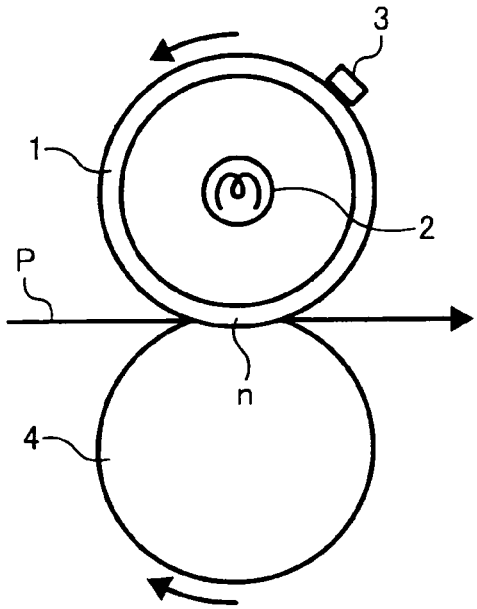
FIG. 1 PRIOR ART
FIG. 1 is an illustration illustrating a cross sectional view of a background image fixing apparatus.
Figure 2:
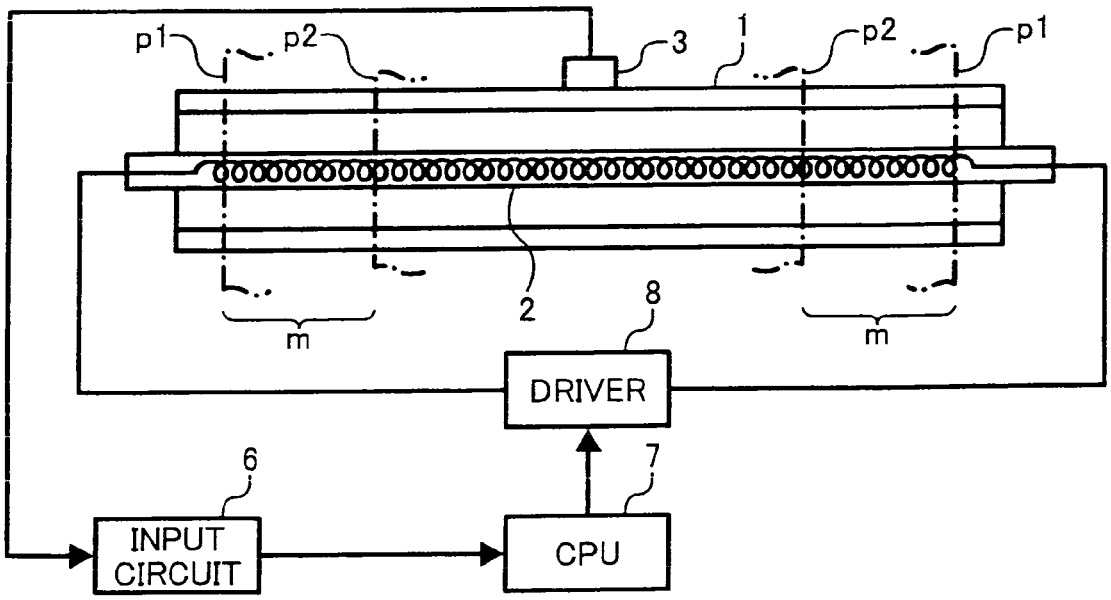
FIG. 2 PRIOR ART
FIG. 2 is another cross sectional view of the image fixing apparatus of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, an illustration illustrating an exemplary configuration of an image forming apparatus according to an embodiment of the present invention is provided.

The image forming apparatus has a tandem color electrophotographic printer engine 10. The tandem color electrophotographic printer engine 10 includes four image forming stations 12, which correspond to four colors of yellow, magenta, cyan, and black, respectively. Each image forming station 12 includes a charger 14, a developer 15, a first transferring member 16, and a first cleaner 17 around a photo-conductor drum 13. An exposure device 18 for four colors is provided under the tandem color electrophotographic printer engine 10. A transferring unit 20 is provided upside of the tandem color electrophotographic printer engine 10.

The transferring unit 20 includes an endless belt as a transferring belt 26, which is tensed by rollers 21, 22, 23, 24, and 25. The transferring belt 26 rotates counterclockwise in FIG. 3. The transferring belt 26 passes through a position of the first transferring between the photo-conductor drum 13 and the transferring member 16 at each image forming station 12.

Further, the transferring belt 26 passes through a position of the second transferring between a second transferring roller 21 and a second transferring member 27. Furthermore, waste toner on the transferring belt 26 is cleaned by a second cleaner 29.

A paper cassette 30, which is detachable, is provided at a lower part of the printer. Paper as the recording medium is put into the paper cassette 30. The printer has a paper conveying area 32 at a right side of the printer in FIG. 3. Paper is fed by a feeding roller 33, and held by resist rollers 34, and passes through the position of the second transferring between the transferring belt 26 and the second transferring member 27 in the paper conveying area 32. Further, the paper passes through a fixing apparatus 35, and is then output by paper exit rollers 36.

When an image is to be formed on the backside of the paper, the paper output from the fixing apparatus 35 is switch-backed in a paper switchback area 37, and the paper is conveyed to the resist rollers 34 again.

Toner bottles 38, which supply toner for the image forming stations 12, are set at an upper part of the printer. The toner bottles 38 correspond to the four colors of yellow, magenta, cyan, and black, respectively.

When a color image forming is performed with this printer, motors (not shown) are driven based on an image signal from a host computer. Then, the photo-conductor drums 13 rotate clockwise, one of the rollers 21, 22, 23, 24, and 25 rotates for driving, the other rollers rotate by being driven, and the transferring belt 26 rotates counter clockwise in FIG. 3.

At each image forming station 12, the surface of the photo-conductor drum 13 is evenly charged by a charger 14. The exposure device 18 exposes the surface of each photo-conductor drum 13 based on the image signal to form electrostatic images. The electrostatic images on the surfaces of the photo-conductor drums 13 are developed to form visible toner images by the developers 15. Then, black, yellow, magenta, and cyan images are formed on the photo-conductor drums 13, respectively. Each toner image on the photo-conductor drums 13 is transferred color by color to the transferring belt 26 to form a four color image in an electric field by the first transferring member 16 at the position of the first transferring.

Meanwhile, the feeding roller 33 rotates counter clockwise based on the image signal, and feeds the paper from the paper cassette 30. The paper is conveyed into the paper conveying area 32, and is stopped with the resist rollers 34. The resist rollers 34 rotate based on the conveying timing of the four color image on the transferring belt 26, and convey the paper to the position of the second transferring. The four color image on the transferring belt 26 is transferred to the paper in an electric field by the second transferring roller 21.

After the second transferring, the paper is conveyed into the fixing apparatus 35, and the transferred image is fixed on the paper by heat and pressure. After fixing, the paper is output onto a paper stack 31 by paper exit rollers 36, or when an image is to be formed on the backside of the paper, the paper output from the fixing apparatus 35 is switch-backed in paper switch-back area 37, and the paper is conveyed to the resist rollers 34 again, and after another transferring and fixing, the paper is output onto a paper stack 31 by paper exit rollers 36.

After the first transferring, each photo-conductor drum 13 is cleaned by its respective first cleaner 17, and the waste toner is removed. Then, each photo-conductor drum 13 is set to standby for a next image. Also, after the second transferring, the transferring belt 26 is cleaned by the second cleaner 29, and the waste toner is removed. Then, the transferring belt 26 is set to standby for the next image.

Figure 3:
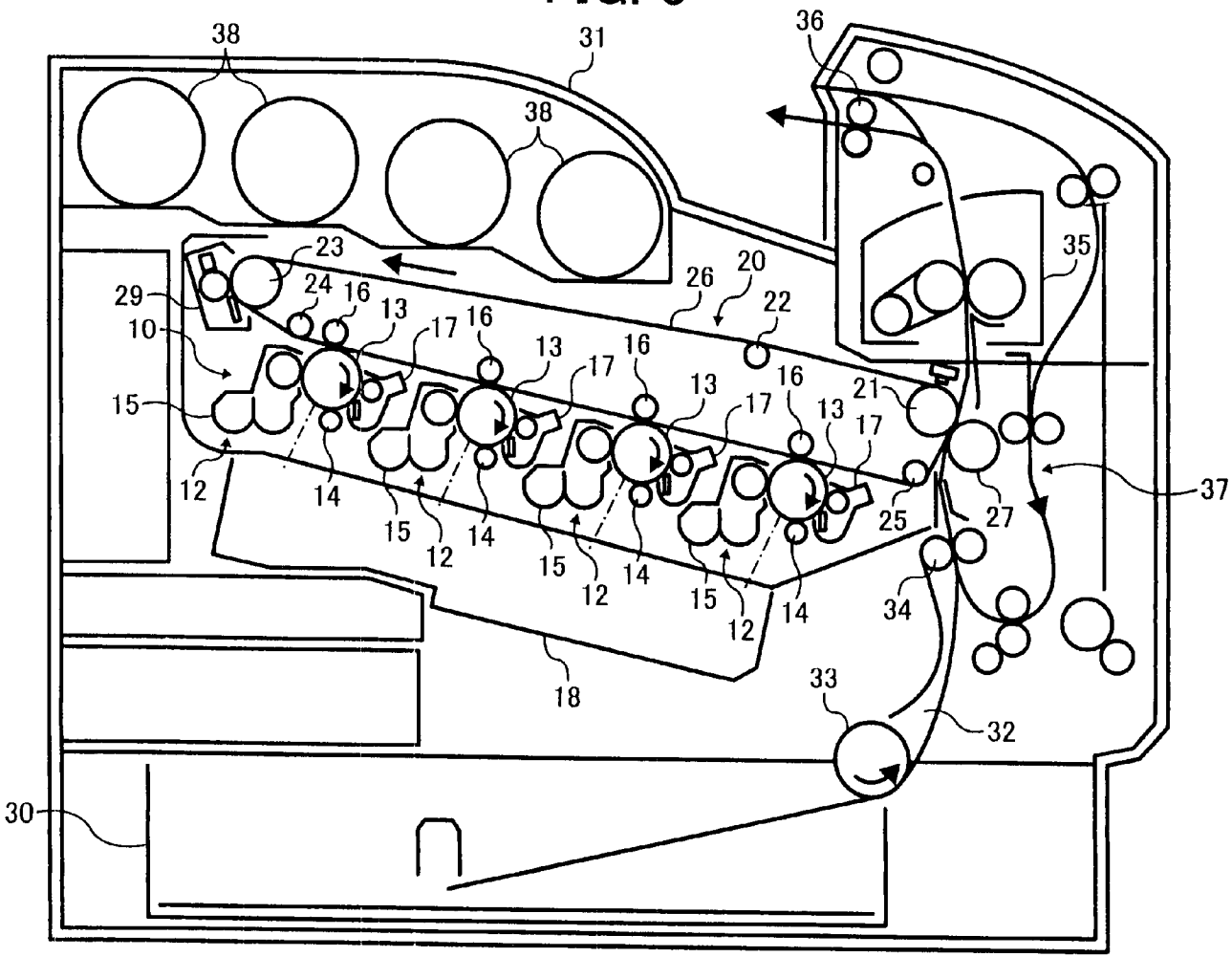
FIG. 3 is an illustration illustrating an exemplary configuration of an image forming apparatus according to an exemplary embodiment of the present invention.
Figure 4A:
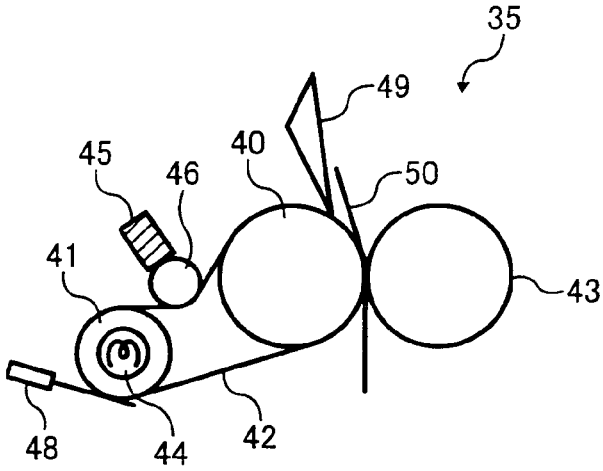
FIG. 4A illustrates an exemplary configuration of the image fixing apparatus of FIG. 3.
Figure 4B:
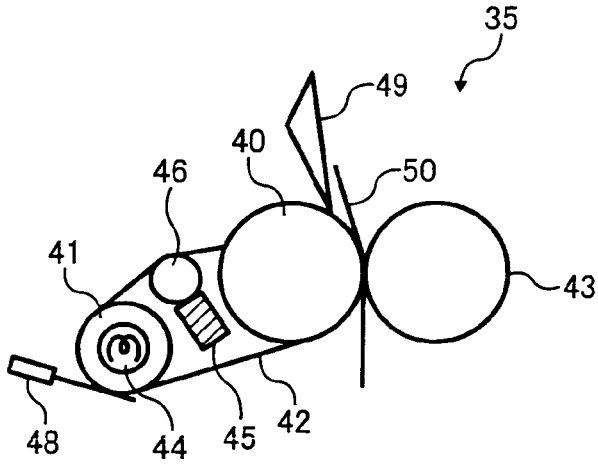
FIG. 4B illustrates an exemplary configuration of the image fixing apparatus of FIG. 3.
Figure 4C:
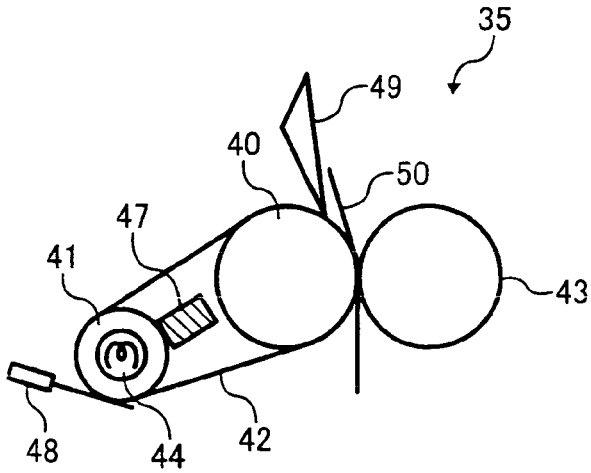
FIG. 4C illustrates an exemplary configuration of the image fixing apparatus of FIG. 3.

FIGS. 4A to 4C illustrate an exemplary configuration of the fixing apparatus 35 of FIG. 3. The fixing apparatus 35 includes a fixing belt 42 which is tensed by a fixing roller 40 and a heating roller 41, and a pressing roller 43 which is pushed by a pushing member (not shown). A fixing nip is formed between the fixing belt 42 and the pressing roller 43.

The fixing roller 40 may have a structure in which a metal roller is covered with silicone rubber. The heating roller 41 may be made of aluminum, iron, etc. with a structure in which the roller 41 has an internal heat source 44. As a heat source 44, a halogen heater or an induction heating (IH) are typically used. The fixing belt 42 may have a structure in which a base layer made of nickel, polyimide, etc. is covered with a surface layer so it is easy to release the paper, such as perfluoroalkoxyalkane (PFA), polytetrafluoroethylene (PTFE), etc. The fixing belt 42 may have an intermediate layer made of silicone rubber, etc. between the surface layer and the base layer. The pressing roller 43 may have a structure in which a metal roller made of aluminum, iron, etc. is covered with an elastic layer, such as silicone rubber, and the elastic layer is covered with a surface layer so it is easy to release the paper, such as PFA, PTFE, etc.

In FIG. 4A, a pushing member 45 pushes a tension roller 46 at an outside of the fixing belt 42 causing tension in the fixing belt 42. In FIG. 4B, a pushing member 45 pushes a tension roller 46 at an inside of the fixing belt 42 causing tension in the fixing belt 42. In FIG. 4C, a pushing member 47 pushes the heating roller 41 causing tension in the fixing belt 42. A thermo sensitive register 48 is provided in contact with the fixing belt 42. A separator plate 49 is provided in contact with the fixing belt 42 near the exit portion of the nip.

When a fixing process is carried out, the heat source 44 is turned on, the fixing roller 40 rotates by action of a motor (not shown), and the heating roller 41, the fixing belt 42, and the pressing roller 43 are driven to rotate. The heat source 44 heats the heating roller 41, and the heating roller 41 heats the fixing belt 42. When paper 50, on which toner is transferred in the second transferring, is passed through the fixing nip region, the toner image on the paper is fixed by heat and pressure. Further, the paper 50 is conveyed by rotating of the fixing belt 42 and the pressing roller 43. Furthermore, the paper 50 is peeled off from the fixing belt 42 by the separator plate 49, and is guided upward, and is output to the paper stack.

Figure 5A:
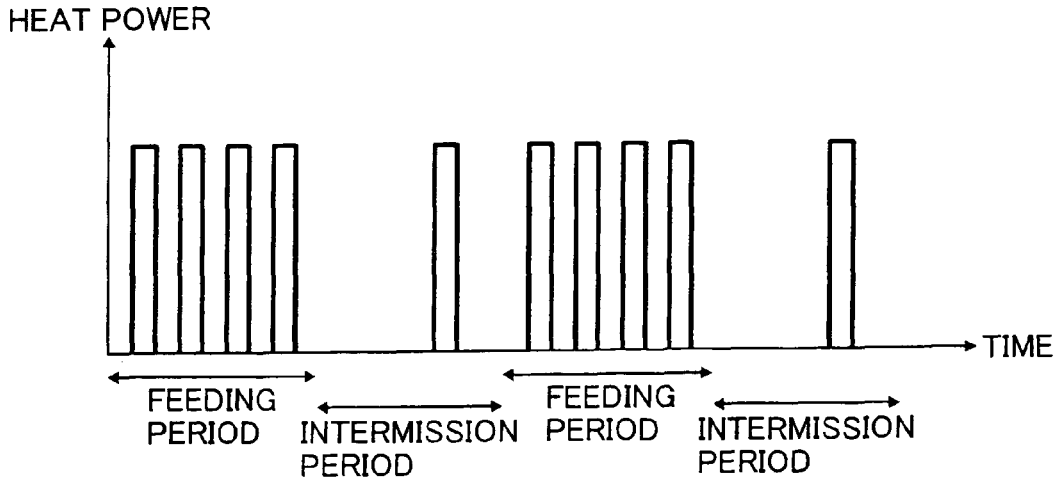
FIG. 5A is a timing chart showing a relation of time and heat power of the image fixing apparatus of FIG. 3.
Figure 5B:
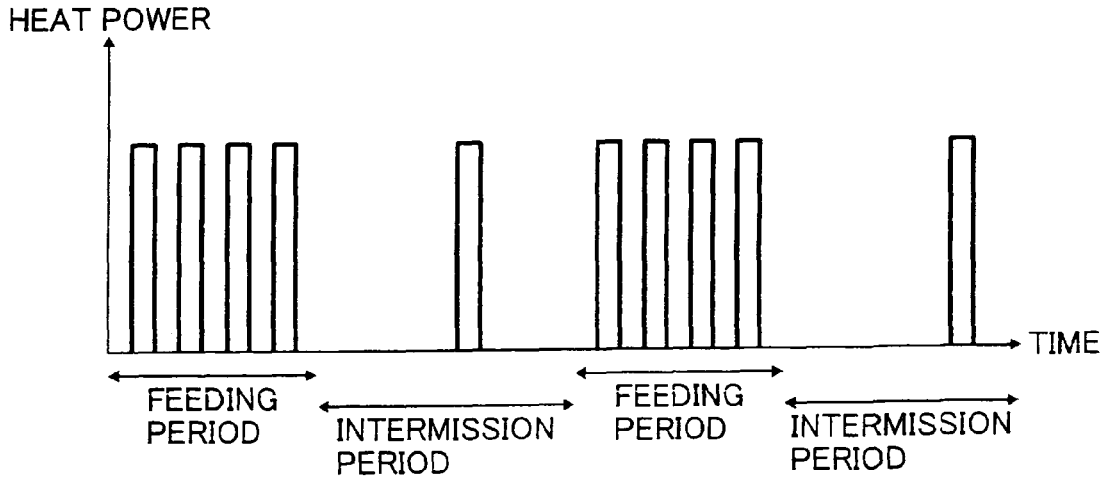
FIG. 5B is a timing chart showing a relation of time and heat power of the image fixing apparatus of FIG. 3.

FIG. 5A and FIG. 5B are timing charts showing a relation of time and heat power of the heat source 44. In the printer, when using paper 50 that has the maximum width for feeding, the heat source 44 is turned on at the timing of FIG. 5A. There is a difference between the turning on time of the heat source 44 when the paper 50 is fed and the turning on time of the heat source 44 when the paper 50 is not fed due to an intermission of feeding. This causes a balance between the heat quantity which is supplied and the heat quantity which is taken by the paper 50 and is lost by heat dispersion.

When using paper 50 that is narrower than the maximum width for feeding, a non-feeding area on both sides of heating roller 41 and fixing belt 42 may have a high temperature because heat in this area is not absorbed in the paper 50 and a supplied heat quantity is larger than a lost heat quantity by heat releasing. Therefore, when continuously feeding the narrower paper into the fixing apparatus 35, the intermission period between feeding may be prolonged, as shown in FIG. 5B. As shown in FIG. 5B, the intermission period is longer compared with the feeding period, so that the temperature of both sides of the fixing belt 42 is controlled for preventing an excessive high temperature, by heat releasing in the intermission period.

When the detected fixing temperature of the fixing apparatus 35 using the thermo-sensitive register 48 is the same, the intermission period may be made longer based on and proportional to the length of the paper 50 in the feeding direction. That is, when the length of the paper 50 in the feeding direction is expressed by a, the length between paper to paper in feeding is expressed by b, a/b may be nearly the same as a predetermined value c. Therefore, when the length of the paper 50 in the feeding direction is longer and is capable of causing a higher temperature at the non-feeding areas on both sides of the fixing belt 42, an even longer intermission period may be used to reduce the temperature of the fixing belt 42.

Thereby, when continuously feeding the narrower paper 50 into the fixing apparatus 35, with consideration of the length of the paper 50, the intermission period between feeding may be set effectively to prevent the temperature of non-feeding areas on both sides of the fixing belt 42 from increasing to be excessively high.

When the detected fixing temperature of the fixing apparatus 35 by the thermo-sensitive register 48 is high enough to be capable of increasing the temperature of non-feeding areas on both sides of the fixing belt 42, the intermission period between feeding may made be longer.

Further, when continuously feeding the narrower paper 50 into the fixing apparatus 35, with consideration of the length of the paper 50 in the feeding direction and the fixing temperature, the intermission period between feeding may be set effectively to prevent the temperature of non-feeding areas on both sides of the fixing belt 42 from increasing to be excessively high further considering such cases that the thickness or type of the paper 50 affects the fixing temperature.

Figure 6A:
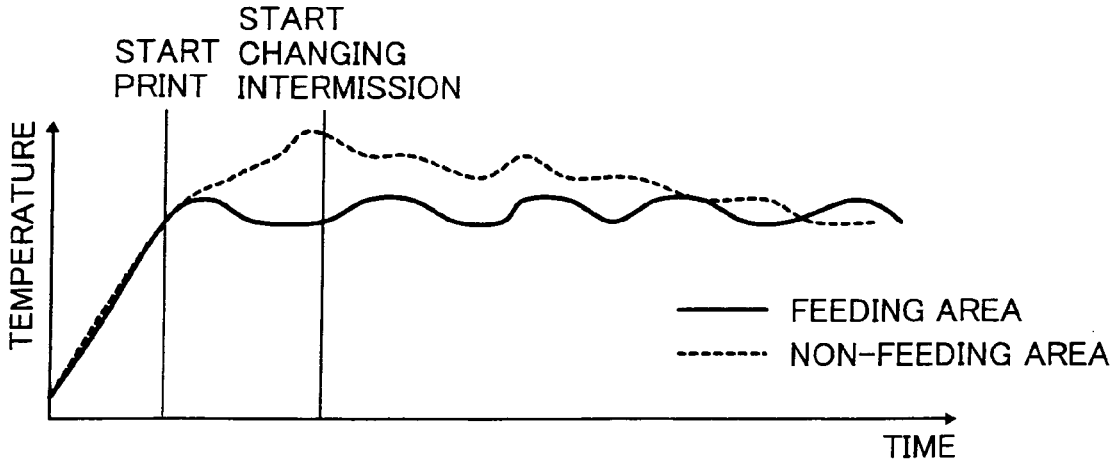
FIG. 6A is a graph showing a relation of time and temperature of the fixing belt of FIG. 3.
Figure 6B:
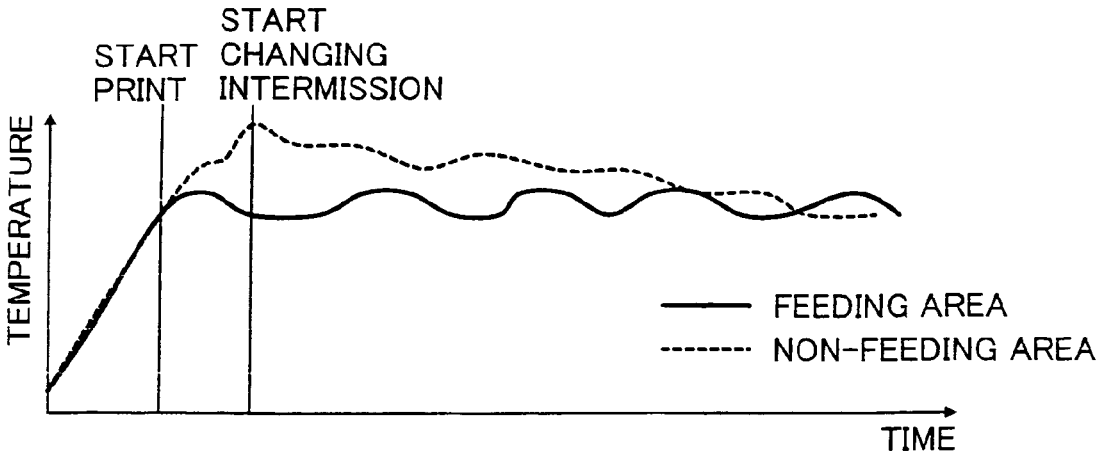
FIG. 6B is a graph showing a relation of time and temperature of the fixing belt of FIG. 3.

FIG. 6A is a graph showing relation of time and temperature of the fixing belt 42 at normal environmental temperatures. FIG. 6B is a graph showing relation of time and temperature of the fixing belt 42 at high environmental temperatures. The printer can be equipped with a temperature detector to detect environmental temperature (although not shown).

As shown in FIG. 6A and FIG. 6B, when the environmental temperature is high, the temperature of non-feeding areas on both sides of the fixing belt 42 may more easily increase rapidly. Therefore, when the detected environmental temperature of the fixing apparatus 35 is higher, the intermission period between feeding may be made even longer. Thereby, when continuously feeding the narrower paper 50 into the fixing apparatus 35, with consideration of the length of the paper 50 in the feeding direction and the environmental temperature, the intermission period between feeding may be set effectively to prevent the temperature of non-feeding areas on both sides of the fixing belt 42 from increasing to be excessively high in such a case that the environmental temperature is high.

When continuously feeding the narrower paper 50 into the fixing apparatus 35, the printer may have a first control operation to prolong the intermission period between feeding and a second control operation to suspend the feeding, and also may have a selector to select the first control operation or the second control operation.

A user may also preferably select the first control operation or the second control operation through such as an operation panel. When the first control operation is selected and the narrower paper 50 is continuously fed into the fixing apparatus 35, the intermission period between feeding may be prolonged to prevent the temperature of non-feeding areas on both sides of the fixing belt 42 from increasing to be excessively high. When the second control operation is selected and the narrower paper 50 is continuously fed into the fixing apparatus 35, the feeding may be suspended until the temperature of non-feeding areas on both sides of the fixing belt 42 decreases to about the same temperature of the feeding area of the fixing belt 42 to prevent the temperature of the non-feeding areas on both sides of the fixing belt 42 from increasing to be excessively high.

When the user selects the second control operation and feeding the narrower paper 50 is suspended due to the high temperature of non-feeding areas on both sides of the fixing belt 42, rotating the fixing belt 42 and the pressing roller 43 decreases the temperature of the non-feeding areas on both sides of the fixing belt 42 rapidly due to the heat transmission from the fixing belt 42 to the pressing roller 43. So, an electromagnetic clutch etc. can be used to intercept other roller's rotation and the fixing belt 42 and the pressing roller 43 are rotated in free time. More particularly, rotating the fixing belt 42 and the pressing roller 43 faster than at a normal printing speed is effective to reduce a waiting time.

In the fixing apparatus 35, when the thickness of the heating roller 41 is not greater than 1.0 mm, the temperature of non-feeding areas on both sides of the fixing belt 42 may easily increase rapidly due to the small heat capacity of the heating roller 41. In this case, when continuously feeding the narrower paper 50 into the fixing apparatus 35, with consideration of the length of the paper 50 in the feeding direction and the width of the paper 50, the intermission period between feeding may be set effectively to prevent the temperature of non-feeding areas on both sides of the fixing belt 42 from increasing to be excessively high.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2005-263515 filed on Sep. 12, 2005 in the Japan Patent Office, the entire contents of which are incorporated by reference herein.

What is claimed:

1. An image forming apparatus for an electrophotographic process, comprising:

an image forming mechanism to form a toner image onto an recording medium;

an image fixing apparatus that fixes the toner image onto the recording medium, including:

a fixing member to heat the toner image, and a pressing member to press the fixing member to form a nip press region through which the recording medium passes so that the toner image is fixed onto the recording medium by heat and pressure;

a conveying mechanism to convey the recording medium into the image fixing apparatus;

a controller to control a gap between the conveyed recording mediums in a feeding direction when a narrower recording medium, narrower than a maximum allowable size, is continuously fed into the image fixing apparatus, the controller further to control the gap between the conveyed recording mediums in a first control operation to be longer than a default gap when the narrower recording medium, narrower than the maximum allowable size, is continuously fed, the controller further to suspend feeding the recording medium in a second control operation; and a selector to select the first control operation or the second control operation, wherein the fixing member and the pressing member are driven to rotate in a free time when the second control operation is selected by the selector.

2. The image forming apparatus of claim 1, wherein the gap between the conveyed recording mediums is controlled to be longer than a default gap based on an increase of the image fixing temperature.

3. The image forming apparatus of claim 1, further comprising:

a temperature detector to detect an environmental temperature;

wherein the gap between the conveyed recording mediums is controlled to be longer than a default gap based on an increase of the environmental temperature.

4. The image forming apparatus of claim 1, wherein the fixing member includes a fixing belt, a fixing roller, and a heating roller having a thickness of no larger than 1.0 mm, and the fixing belt is tensed to rotate between the fixing roller and the heating roller.

5. An image fixing apparatus that fixes a toner image onto an recording medium, comprising:

a fixing member to heat the toner image; and a pressing member to press the fixing member to form a nip press region through which the recording medium passes so that the toner image is fixed onto the recording medium by heat and pressure; and a controller to, when a narrower recording medium, narrower than a maximum allowable size, is continuously fed at an image fixing temperature, control a gap between the conveyed recording mediums to be longer than a default gap based on a length of the recording medium in a feeding direction, the controller further to control the gap between the conveyed recording mediums in a first control operation to be longer than a default gap when the narrower recording medium, narrower than the maximum allowable size, is continuously fed;

the controller further to suspend feeding the recording medium in a second control operation; and a selector to select the first control operation or the second control operation, wherein the fixing member and the pressing member are driven to rotate in a free time when the second control operation is selected by the selector.

6. An image fixing method for fixing a toner image onto an recording medium, comprising:

maintaining an image fixing temperature by controlling a heater of a fixing member;

pressing the fixing member by a pressing member to form a nip press region through which the recording medium passes so that the toner image is fixed onto the recording medium by heat and pressure;

continuously feeding a narrower recording medium, narrower than a maximum allowable size; and controlling, by a controller, a gap between the conveyed recording mediums to be longer than a default gap based on a length of the recording medium in a feeding direction, the controlling including:

a first control operation to control the gap between the conveyed recording mediums to be longer than a default gap when the narrower recording medium, narrower than the maximum allowable size, is continuously fed, a second control operation to suspend feeding the recording medium; and selecting the first control operation or the second control operation, wherein the fixing member and the pressing member are driven to rotate in a free time when the second control operation is selected.

7. The image fixing method of claim 6, wherein the gap between the conveyed recording mediums is controlled to be longer than a default gap based on an increase of the image fixing temperature.

8. The image fixing method of claim 6, further comprising:

detecting an environmental temperature by a temperature detector and controlling the gap between the conveyed recording mediums to be longer than a default gap based on an increase of the environmental temperature.

9. An image forming apparatus for an electrophotographic process, comprising:

means for forming a toner image onto an recording medium;

means for fixing the toner image onto the recording medium, including:

means for heating the toner image, and means for pressing the means for heating to form a nip press region through which the recording medium passes so that the toner image is fixed onto the recording medium by heat and pressure;

means for conveying the recording medium into the image fixing apparatus; and means for controlling a gap between the conveyed recording mediums in a feeding direction when a narrower recording medium, narrower than maximum allowable size, is continuously fed into the means for fixing, the means for controlling can selectively control the gap between the conveyed recording mediums to be longer than a default gap when the narrower recording medium, narrower than a maximum allowable size, is continuously fed, and the means for controlling selectively suspends feeding the recording medium, wherein the means for heating and the means for pressing are driven to rotate in a free time when the means for controlling suspends feeding the recording medium.

10. The image forming apparatus of claim 9, wherein the gap between the conveyed recording mediums is controlled to be longer than a default gap based on an increase of the image fixing temperature.

11. The image forming apparatus of claim 9, further comprising:

means for detecting an environmental temperature;

wherein the gap between the conveyed recording mediums is controlled to be longer than a default gap based on an increase of the environmental temperature.

12. The image forming apparatus of claim 9, wherein the means for heating includes a fixing belt, a fixing roller, and a heating roller having a thickness of no larger than 1.0 mm, and the fixing belt is tensed to rotate between the fixing roller and the heating roller.

13. An image fixing apparatus that fixes a toner image onto an recording medium, comprising:

means for heating the toner image; and means for pressing the means for heating to form a nip press region through which the recording medium passes so that the toner image is fixed onto the recording medium by heat and pressure;

means for controlling, when a narrower recording medium, narrower than a maximum allowable size, is continuously fed at an image fixing temperature, a gap between the conveyed recording mediums to be longer than a default gap based on a length of the recording medium in a feeding direction, the means for a first controlling can selectively control the gap between the conveyed recording mediums to be longer than a default gap when the narrower recording medium, narrower than the maximum allowable size, is continuously fed, the means for controlling selectively suspends feeding the recording medium, and wherein the means for heating and the means for pressing are driven to rotate in a free time when the means for controlling suspends feeding the recording medium.

* * * * *